PTU05 XR 4,174,577

United States Patent [19]

Lewis

[11] 4,174,577

[45] Nov. 20, 1979

[54] BOREHOLE DRIFT-DIRECTION PROBE

[75] Inventor: John R. Lewis, Stow, Mass.

[73] Assignee: Harnessed Energies, Inc., Maynard, Mass.

[21] Appl. No.: 904,273

[22] Filed: May 9, 1978

[51] Int. Cl.[2] ..... G01C 9/00

[52] U.S. Cl. ..... 33/302; 33/304; 33/362

[58] Field of Search ..... 33/302, 304, 308, 310, 33/312; 313, 355, 362

[56] References Cited

U.S. PATENT DOCUMENTS

| | | | |
|---|---|---|---|
| 3,587,175 | 6/1971 | Armistead | 33/312 |
| 3,791,043 | 2/1974 | Russell | 33/312 |
| 4,013,946 | 3/1977 | Lewis | 33/328 |
| 4,021,774 | 5/1977 | Asmundsson et al. | 33/304 |

*Primary Examiner*—William D. Martin, Jr.
*Assistant Examiner*—Robert Ferrer
*Attorney, Agent, or Firm*—Hopgood, Calimafde, Kalil, Blaustein & Lieberman

[57] ABSTRACT

The invention contemplates use of a single magnetic-field (flux) sensor mounted within an elongate probe housing, to continuously generate telemetered electric signals from which the instantaneous orientation of the housing is at all times known and from which changes in orientation may be tracked as a function of probe depth within the borehole in which the probe housing may be displaced. The telemetered electric signals provide accurate and current indications of (a) magnitude of the horizontal component of the earth's magnetic-field lines, (b) direction and magnitude of probe-axis tilt with respect to the gravitational vertical, and the direction of the earth's magnetic field, and (c) a probe-housing frame-angle reference; provision being made within the probe housing for performing substantially all discriminating, detecting and other problem-solving functions, whereby the telemetered signals are directly utilizable by recording and/or display equipment at surface end of the borehole site.

36 Claims, 12 Drawing Figures

Fig. 9.
Fig. 8.
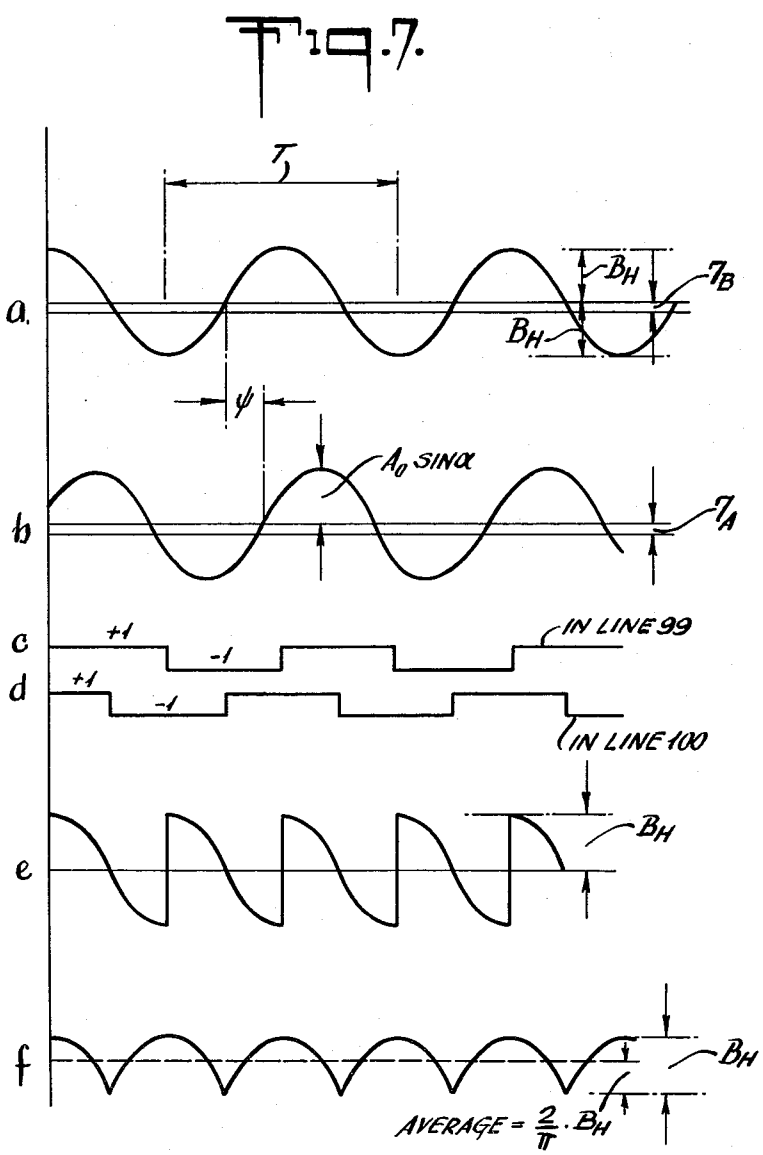
Fig. 7.
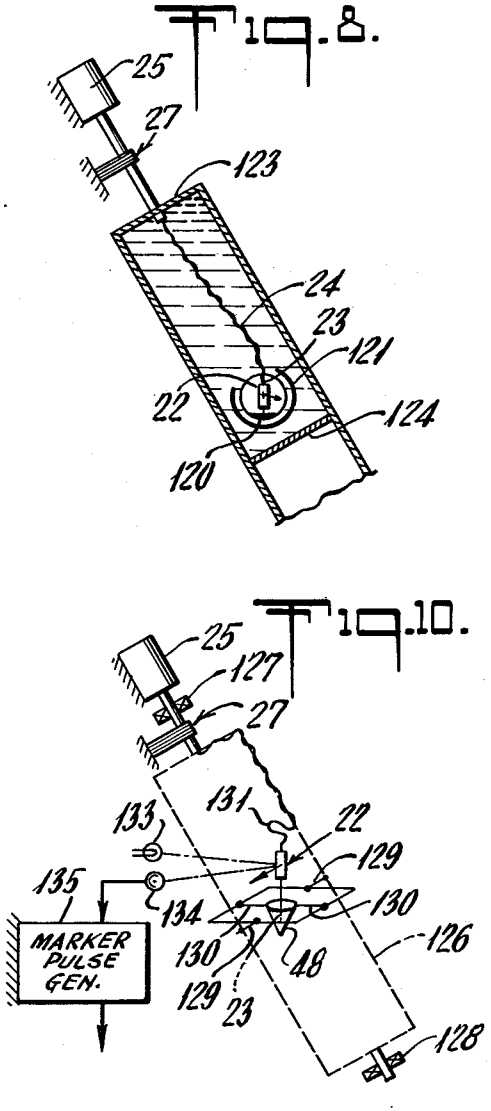
Fig. 10.
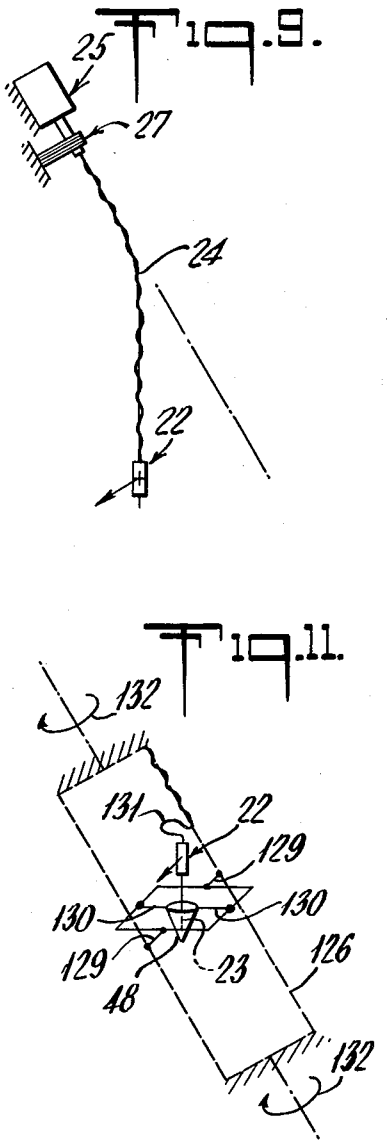
Fig. 11.

BOREHOLE DRIFT-DIRECTION PROBE

This invention relates to a method and means for remotely determining the instantaneous orientation of a body relative to a coordinate system based on the earth's magnetic and gravitational fields. The invention will be described in the context of an elongate probe configurated to orient its axis of exterior symmetry in locally tangent relation to a borehold drilled into the earth, as for mineral-ore prospecting, oil-well drilling and the like, and the invention is applicable anywhere except at the magnetic poles, or where the earth's magnetic field is erratic or unmapped.

A borehole of the character indicated cannot be relied upon to be straight and vertical, in that the drilling of the hole is subject to laterally deflecting obstacles, forces and other asymmetries which can account for substantial offsets from the point of earth entry, the deeper the borehole; typically, such drift in a mineral-drilling operation can be as much as 340 feet per 1000 feet of borehole. A problem is thus presented of determining a three-dimensional map of the borehole. To this end, a suitable probe is lowered into the borehole. For mineral-ore prospecting, the probe is typically in the shape of an elongate cylinder, of 2¼-in. diameter and 6-ft. length, so that the axis of the cylinder will essentially lie parallel to the tangent of the borehole. A device located in the probe to determine the inclination and azimuth of the probe then necessarily determines the orientation of the tangent to the borehole as a function of the amount of cable paid out, and this is sufficient information from which to make a three-dimensional map of the borehole.

A straightforward approach to determining probe azimuth and inclination would be to use multiple sensors to measure the components of the earth's magnetic field along three orthogonal axes fixed in the probe, and inclination relative to two of these axes. Suitable manipulation of resulting data would then yield azimuth and inclination. A reduction in the number of independent measurements needed to achieve this result can be achieved by gimbal-suspension of the magnetic-field sensor to eliminate sensitivity to the earth's vertical field, and by mounting the inclinometer on a servo-driven platform which is kept level on one axis. Even so, multiple sensors are required, and inaccuracies can be introduced as a result.

A well-known technique which does not have the above-noted disadvantage employs a small sphere engraved with longitude and latitude lines. The sphere is bottom-heavy, contains a magnet, and is suspended in a liquid, with rotational freedom to assume a position of equilibrium (a) in response to the earth's magnetic-field influence upon the magnet and (b) in response to gravitational influence upon the bottom-heavy property. The sphere thus tends to assume a fixed relation to the earth, and by photographing the sphere as viewed by a camera fixed to the probe, the orientation of the probe can be deduced. Among the limitations of this technique are time lag to achieve equilibrium for each photograph, and the need to remove the probe from the borehole for film development and evaluation, in that it is not convenient to convert the data to a form that can be telemetered to the surface; specifically, the technique has been incapable of providing at the surface a continuous and current record of probe orientation as the probe is moved down the hole.

It is accordingly an object of the invention to provide an improved method and means for providing probe orientation data, and not subject to deficiencies noted above.

A specific object is to provide a method and means for continuously generating and remotely transmitting data of the character indicated, with superior accuracy and reliability, and currently, in the course of probe movement along a borehole.

Another specific object is to achieve the foregoing objects without using more than a single magnetic-field sensor.

It is also a specific object to provide in a probe of the character indicated means whereby a single magnetic-field sensor may continuously generate tilt-azimuth and inclination data, referenced to the azimuth component of the earth's magnetic field.

A further specific object is to provide a device of the character indicated which will continuously determine strength of the horizontal component of the earth's magnetic field, as a means of continuously verifying validity of derived orientation data.

A still further object is to materially reduce uncertainty in borehole mapping, to a level in the order of ±2.5 feet per 1000 feet of borehole depth.

It is a general object to achieve the above objects with rugged and basically simple structure which is reliably operable in an environment of mechanical shock, as when employed in conjunction with a drilling operation.

Other objects and various further features of novelty and invention will be pointed out or will occur to those skilled in the art from a reading of the following specification, in conjunction with the accompanying drawings. In said drawings which show, for illustrative purposes only, preferred embodiments of the invention:

Figure 3:
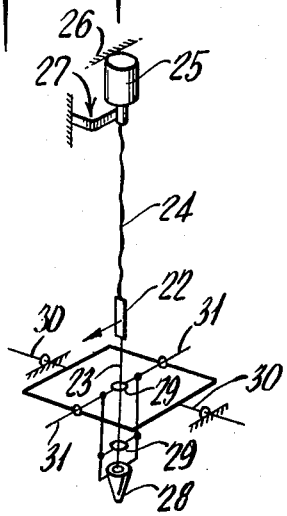
FIG. 3 is a simplified view in perspective schematically showing orientation and suspension system for the single magnetic sensor of the probe.
Figure 6A:
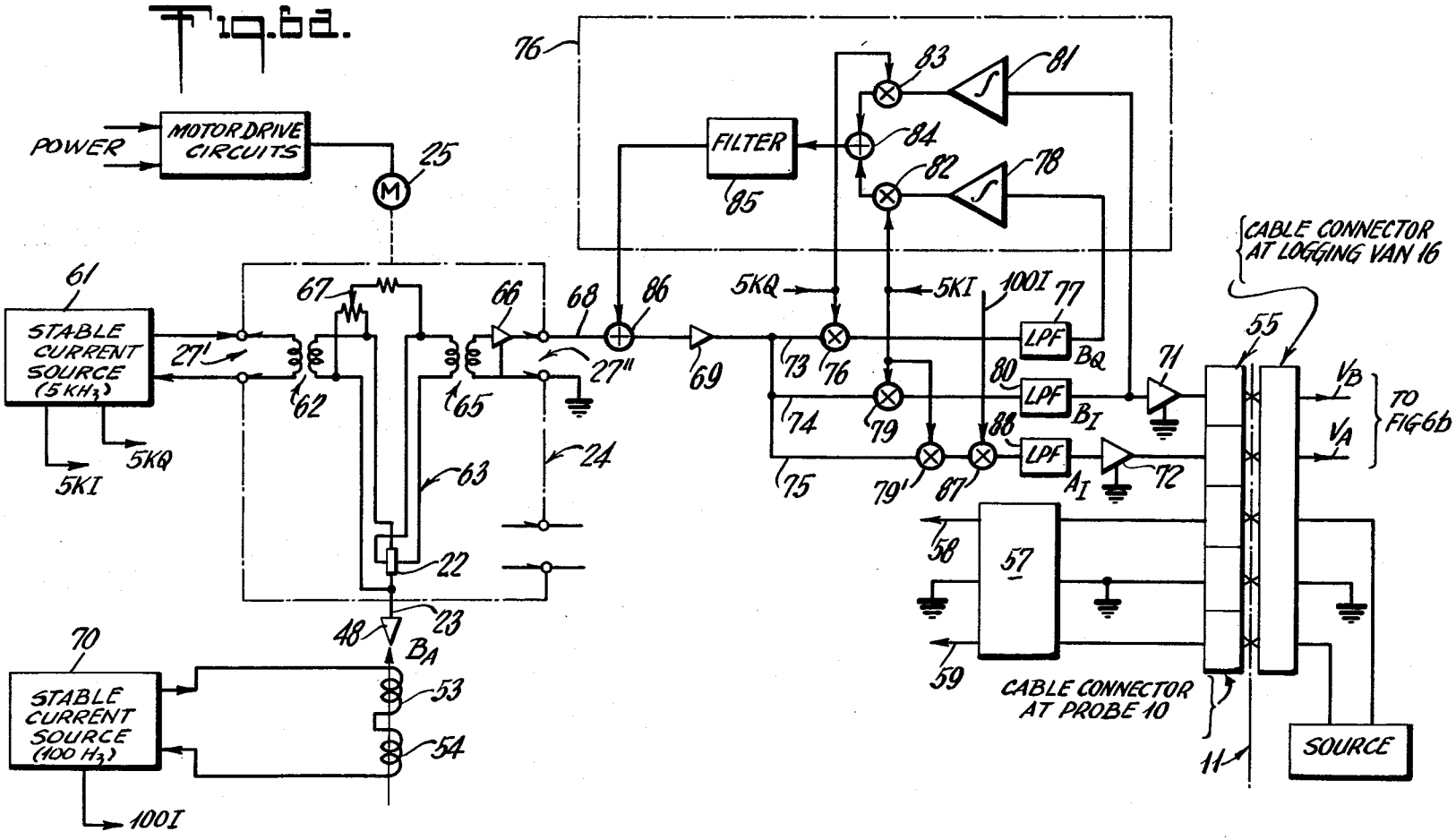
Figure 6B:
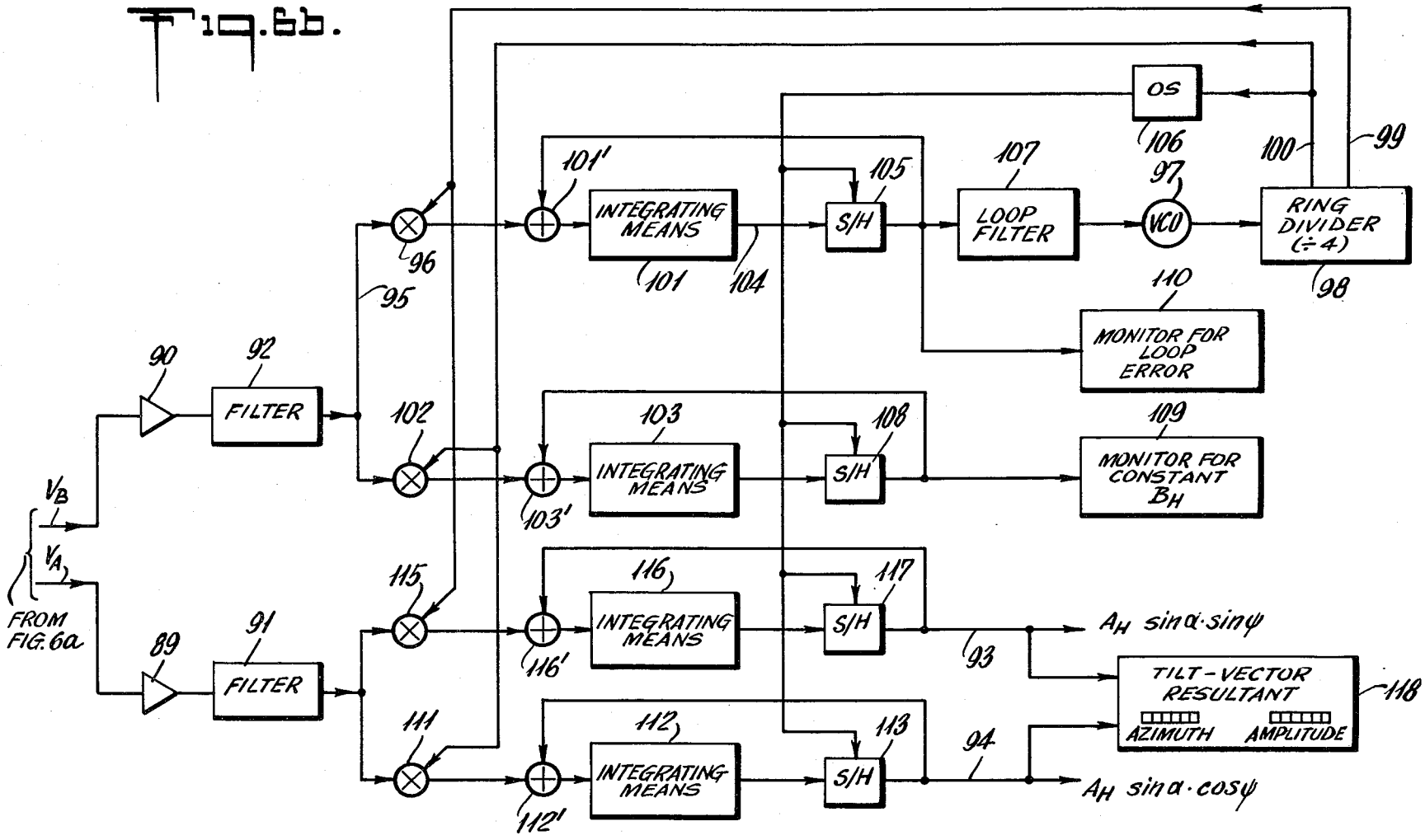

FIGS. 6*a* and 6*b* are two sheets of an electrical block diagram to show circuit components within the probe and at the remote readout, respectively;

FIG. 7 is a series of graphs to depict, to the same time scale, electrical signals within readout circuitry of FIG. 6;

FIGS. 8, 9, 10 and 11 are diagrams similar to FIG. 3 to illustrate modifications.

Figure 1:
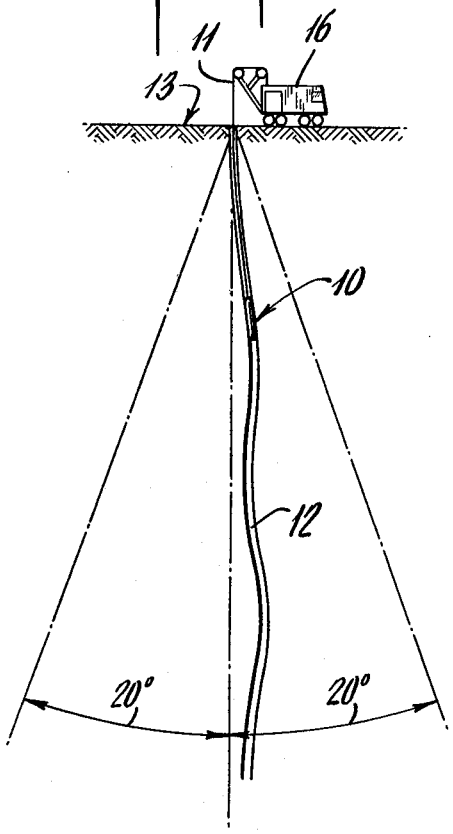
FIG. 1 is a simplified diagram in elevation to show the relation between surface and probe components of the invention as used in the mapping of a borehole.
Figure 2:
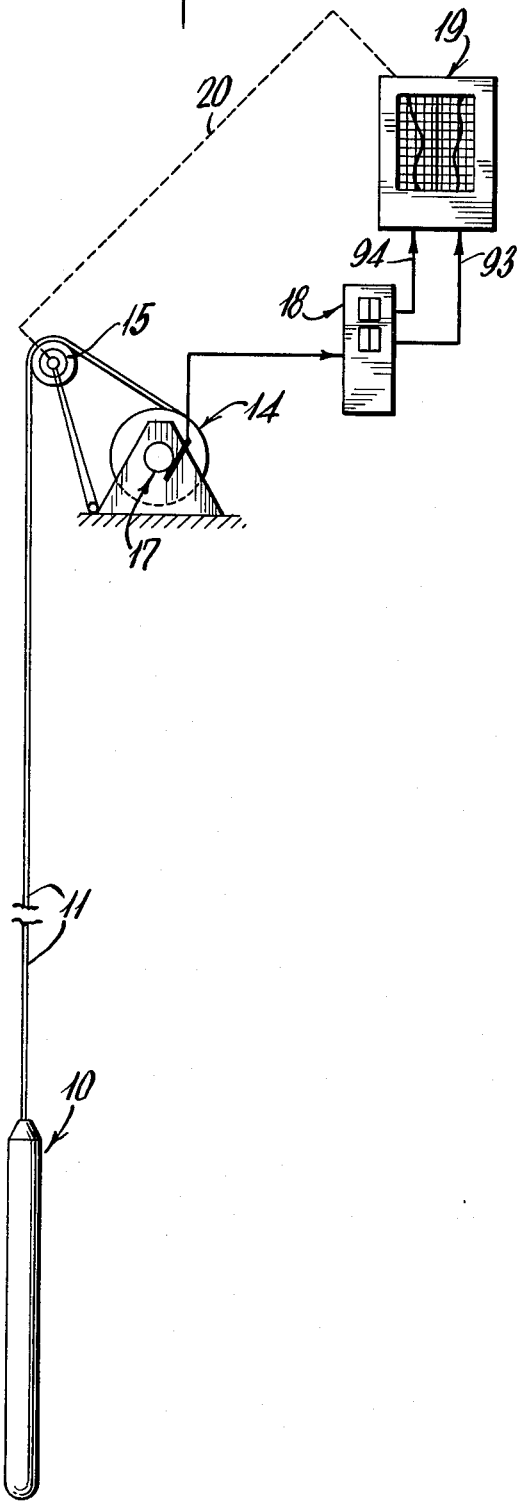
FIG. 2 is an enlarged and somewhat schematic diagram of structural components of FIG. 1.

Referring initially to FIGS. 1 and 2, the invention is shown in application to an elongate cylindrical probe 10 suspended via an armored multiple-conductor electrical cable 11, within a borehole 12 of undetermined drift beneath a surface-drilling site 13. In mineral prospecting, such drift is customarily well within 20 degrees of the vertical, as suggested by legend in FIG. 1. The cable 11 is paid out from a winch 14 and over a footage wheel 15, serving with readout and recording equipment contained in a logging van 16. The winch means 14 is equipped with slip-ring pick-off means 17 for conducting separate signals from conductors of cable 11 to readout circuitry 18, which in turn provides outputs as desired for mapping purposes. As shown, segregated "North" and "East" component signals are independently supplied by such outputs to separate pen-displacement inputs of a dual-chart moving-strip recorder 19, having a synchronizing chart-drive connection 20 to the footage wheel 15. Power for probe operation is supplied from van 16 via cable 11, and various signal-processing circuits at the probe yield two telemetered output signals via the cable; these signals are of the same frequency and are graphically suggested alongside the slip-ring connection to readout device 18 in FIG. 2, being a first output signal A which is cyclically responsive to instantaneous probe-axis inclination with respect to the vertical, and a second output signal B which is cyclically responsive to the horizontal component of the earth's magnetic field. The legend in FIG. 2 additionally indicates an angle $\psi$ of phase offset between signals A and B, and it will later be explained how these signals and the angle $\psi$ are utilized to develop the respective North and East components needed for map recording at 19.

Briefly stated, the invention contemplates use of a single directionally responsive magnetic-field or flux sensor which is caused to cyclically scan in a horizontal plane to develop response to the horizontal component of the earth's magnetic field and which at the same time also scans for the horizontal component of a locally imposed magnetic field in which the sensor is immersed and which is characterized by magnetic lines that are parallel to the probe axis. Since the latter field is locally imposed it may be on-off or otherwise modulated to provide a basis of segregation from the earth's field component of sensor output. And in the preferred form to be described, such segregating, field-generating and other synchronizing functions and signals are locally generated and processed within the probe itself, enablingthe indicated A and B signals (or signals from which the A and B signals can be readily further discriminated) to be telemetered to the readout device 18. The simplified diagram of FIG. 3 is useful as an introduction to a description of suspension and orientation structure to enable such operation of a single flux sensor within the probe 10. Throughout the description, it will be understood that except for the flux sensor, all housing and other parts near the flux sensor are non-magnetic, meaning that they are inherently non-magnetic or that they have been effectively demagnetized; for example, a stainless-steel probe housing or case is to be preferred for its strength and durability, and it is suitably demagnetized prior to probe assembly.

The single magnetic-field sensor used in my invention may be of the Hall-effect type, the flux-gate type, the rotating-coil type, or an eddy-current type as disclosed in U.S. Pat. No. 4,013,946; however, it is my preference to employ the Hall-effect type, due to its directional sensitivity, small size and weight. The single flux sensor 22 in FIG. 3 is thus preferably a Hall-effect transducer, mounted to a supporting spindle 23 to that its directional response is normal to the spindle axis, as suggested by an arrow labeled n. Spindle 23 is suspended by a universal coupling 24 from the output shaft of motor means 25, the latter being fixedly mounted to the probe case, as suggested at 26; a length of piano wire serves admirably as the universal coupling 24, and the necessary leads to and from transducer 22 may be of fine enameled wire loosely wrapped about the piano wire to slip-ring means 27 at the motor output shaft. The motor means 25 may include reduction gearing to provide a continuous low frequency torsion drive of spindle 23, causing the directional axis n of the flux sensor to cyclically scan about the spindle axis, which must be maintained truly vertical for accomplishement of the desired horizontal-plane scan of the magnetic-response axis n. In the form shown, a pendulous mass 28 is part of a frame for two vertically spaced bearings 29 in which spindle 23 is rotatable and with respect to which spindle 23 has a limited range of vertical displaceability, and the frame for pendulous mass 28 is suspended from the case by a gimbal system on two crossed axes 30–31. The system thus far described will be seen to cyclically cause the response axis n of sensor 22 to scan a horizontal plane about the pendulum-erected vertical spindle 22, producing a low-frequency output signal which is maximum when traversing magnetic North, which is minimum when traversing magnetic South, and which is an a-c coupled situation changes polarity in opposite directions upon traversing East and West, respectively. The above-indicated signal B is thus uniquely defined, and this is true regardless of probe tilt within the limits of pendulous departure from the probe axis, because scanning is always in a horizontal plane.

Figure 4:
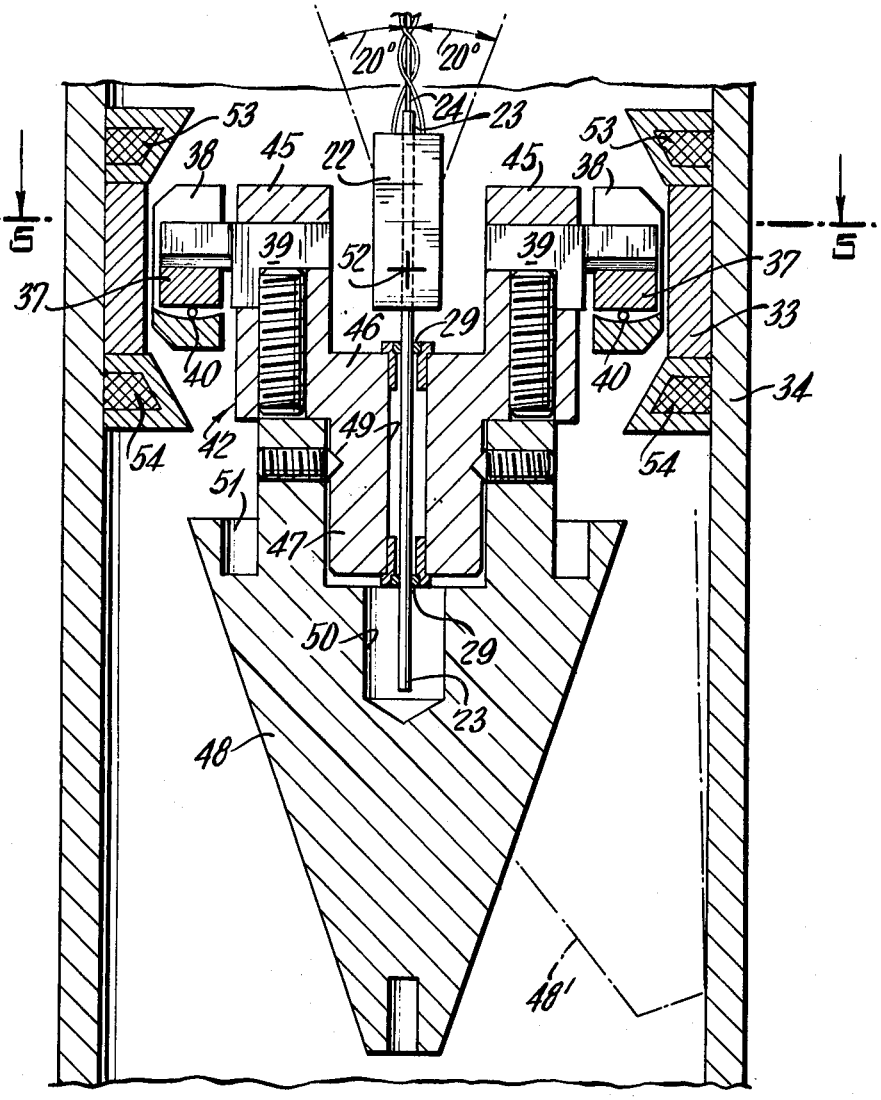
FIG. 4 is an enlarged fragmentary longitudinal sectional view of orientation structure for the single magnetic-field sensor of the probe.
Figure 5:
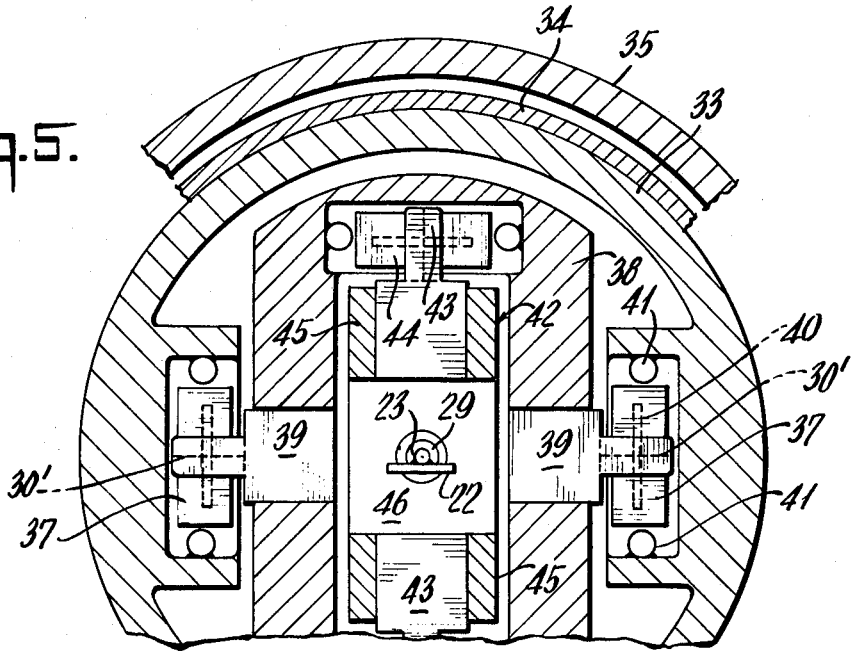
FIG. 5 is a fragmentary plan view of the orientation structure of FIG. 3, as viewed generally from the elevation 5—5 of FIG. 4.

Referring now to FIGS. 4 and 5 for greater detail, the pendulous mechanism for spindle orientation in the vertical is seen to comprise an annular gimbal mount 33 of circular outer contour to fit and be secured in a tubular cylindrical chassis 34, which is later fixedly assembled in the probe housing or pressure case 35 already mentioned. At each of two diametrically opposed locating pockets 36 (FIG. 5) an agate bearing block 37 is retained with limited freedom to permit knife-edge suspension of an outer gimbal 38 on the gimbal axis 30. For each such bearing, a knife-insert element 39 is clamped to outer gimbal 38 and projects outwardly for knife-edge engagement at 30' in a V-groove of the associated agate block 37. Within each pocket 36, a bottom rocker 40 enables uninhibited full knife-edge bearing engagement, and side-rocker elements 41 provide lateral clearance to further assure such uninhibited bearing engagement. In similar fashion, an inner gimbal 42 mounts knife-insert elements 43 to establish the gimbal axis 31 at knife-edge bearing engagement 31' with a V-groove of an associated one of two diametrically opposed agate blocks 44 carried by the outer gimbal 38. The inner gimbal 42 is generally U-shaped, with knife inserts 43 clamped to spaced arms 45 which are interconnected below axis 31 by a base 46 which includes a central downward stud 47 for clamped retention of a pendulum bob 48. A central bore 59 through base 46 and stud 47 communicates with a deep bore 50 in the bob 48, and the spindle bearings 29 are provided as spaced annular jewel elements mounted to the upper and lower ends of bore 49. The spindle 23 is seen to be vertically stabilized by and rotatable in bearings 29, with ample freedom within bore 50 for such longitudinal displacement as may be occasioned by pendulum accommodation to a tilted probe. As shown, the bob 48 is conical and has freedom for accommodation to probe tilt within the $\pm$ 20 degree range indicated in FIG. 1. Also, the bob 48 is shown with an upwardly open annular groove 51, providing space for affixing such eccentrically mounted balancing weights as may be necessary to assure a desired precision of vertical-axis orientation for spindle 23.

The described two-axis gimbal suspension will be seen to place the flux sensor 22 at the intersection of gimbal axes 30–31. In FIG. 4, this location is identified at 52, and it is to be understood that the mark 52 also identifies the axis of directional sensitivity of sensor 22, thus assuring that horizontal-plane scanning by sensor 22 will at all times be essentially about the center of the chasis 34, i.e., regardless of the degree of tilt which may be applicable in the course of continuous horizontal plane scanning.

To locally establish a magnetic field of straight lines parallel to the probe axis, and with the flux sensor 22 consistently immersed therein, like axially spaced upper and lower coil windings 53–54 are developed and suitably potted as annuli fixedly assembled to the gimbal mount 33. These windings are electrically connected in flux-aiding relation and are excited by a carrier source local to the probe, as will be later explained. The effective diameter of windings 53–54 is at least as great as their axial separation, being preferably twice as great, as shown. Also, windings 53–54 are spaced equally above and below the axial location 52 of the directional axis n of the flux sensor 22. It will be seen that on a consideration of sensor rotation in the sole presence of the parallel-line field established by windings 53–54, the sensor-output signal will be cyclically varying with a magnitude which directly reflects the current degree of probe tilt from the vertical, and that the phase offset of such signal with respect, say, to North, will be a direct measure of the azimuth component of the tilt. Thus, the sensor-output signal attributable solely to horizontal-plane scanning of the local field established upon excitation of windings 53–54, will be that which has already been identified as signal A (FIG. 2), it being understood that, in the presence of any periodic modulation of such field excitation (e.g., at a rate materially in excess of the scan rate), signal A is represented by the envelope of the modulation.

The left half of FIG. 6, namely up to and including a cable connector 55, depicts electrical circuitry of the probe 10; to the right of a corresponding connector 56, FIG. 6 depicts circuitry of the readout device 18, it being understood that various of the conductors of cable 11 provide intervening connections. Three of the terminals of connector 55 are committed to reception of externally applied a-c power, with a central ground, the same being applied to suitable means 57 for providing regulated power supply voltage at output terminals 58–59 for various operating uses at the probe. One of these uses involves drive circuitry 60 for powering the motor 25, which it will be recalled operates through reduction gearing to impart rotation in the order of 1 Hz to the flux sensor 22, via its supporting spindle 23. In FIG. 6, the phantom outline 24' indicates the motor-driven rotating assembly of wire 24, spindle 23, sensor 22, and thin-lead connectionsto the slip-ring system 27 of FIG. 3. Specifically, a first stable current source 61, operating from the power supply 57, provides carrier current via supply slip rings 27', to the rotating transducer assembly, an impedance-matching transformer 62 being employed in the supply-lead connection 63 to the flux sensor 22; legend suggests a carrier frequency of 5 kHz. In similar fashion, the sensor-output connection 64 is via an impedance-matching transformer 65 and preamplifier means 66 to output slip rings 27'', for further processing in non-rotating circuitry; a "coarse-offset" potentiometer adjustment at 67 is additionally shown on the rotating structure for balanced treatment of input vs. output lead connections to the sensor 22. With the components thus far described in FIG. 6, the output in line 68 to an amplifier 69 will be seen to be a sinusoidal envelope at 1 Hz on the 5 kHz carrier from source 61, the envelope being the product of cyclical scan of the horizontal component of the earth's magnetic field.

To additionally scan for tilt, a second stable current source 70, also operating from the power supply 57, provides sinusoidal carrier current at 100 Hz to the windings 53–54 for establishing the axially oriented local field in which sensor 22 scans in a horizontal plane. Thus, the output in line 68 to amplifier 69 will be seen to additionally reflect mixing with the 100 Hz carrier and its 1 Hz envelope representing the tilt scan.

To demodulate and segregate the signal A and signal B envelopes from the output mix at amplifier 69, I find it convenient and effective to employ synchronous-detection techniques wherein square-wave outputs of the generators 61–70 provide the requisite synchronization control. Thus, the 5 Khz source is shown with square-wave outputs, labelled 5 kI and 5 kQ, being square waves at 5 kHz; the 5 kI output is In phase with the sinusoidal output to slip rings 27' for exciting the sensor 22, and the 5 kQ output is in Quadrature relation thereto. Similarly, for 100-Hz detection purposes, the 100-Hz source 70 provides an In-phase square-wave output 100 I. The In-phase square-wave outputs are employed to process signals for telemetering in the separate cable lines, designated $V_B$ and $V_A$ (i.e., essentially the B and A signals previously referred to), respectively at the outputs of line drivers 71–72, and destined ultimately to provide the "North" and "East" recording signals after processing at the readout device 18; additionally, the In-phase and Quadrature-phase square waves 5 kI and 5 kQ are used to develop a continuous corrective signal for automatic suppression of such zero-frequency envelope offset as may develop in the sensor output, in spite of the measures taken at 67 to effect at least a coarse correction of the offset.

For the foregoing purposes, the circuit of FIG. 6 operates upon the output of amplifier 69 through three parallel circuit lines 73–74–75, the first two of which serve a circuit 76 for automatic-offset suppression, and the latter two of which serve the respective line drivers 71–72. In line 73, a mixer 76 is supplied with the quadrature square wave 5 kQ, and the product is subjected to low-pass filtering (e.g., 0 to 1 kHz) at 77 to develop an earth's field horizontal-scan quadrature signal $B_Q$ for integration at 78 to become a first d-c signal component for offset suppression; similarly, in line 74, a mixer 79 is supplied with the in-phase square wave 5 kI, and the product is subjected to low-pass filtering at 80 to develop an earth's field horizontal-scan in-phase signal $B_I$ for integration at 81 to become a second d-c signal component for offset suppression. The respective d-c signals are then multiplied (with the 5 kI and 5kQ square waves) at mixers 82–83, before summing at 84 and filtering at 85 to pass essentially only an offset-correcting 5 k Hz signal for corrective summation at 86 with the output signal at 68, produced by sensor rotation.

For telemetering purposes, the development of the earth's field scan signal $V_B$ has already been explained. And the tilt-scan signal $V_A$ will be understood to be similarly produced in line 75, by means of a first mixer 79' supplied in parallel with mixer 79 with the same In-phase square wave 5 kI, but additionally subject to second mixing at 87 with the In-phase square wave 100

I below low-pass filtering at 88 to create an $A_I$ signal output to the line driver 72.

It may be helpful at this point to provide a generalized catalog of various frequency components which will be found in the respective telemetered signal outputs $V_B$ and $V_A$ from the described probe circuitry, as follows:

Signal $V_B$:

At zero frequency
very small, due to offset-suppression measures, at 67 and at 76.

At 1 Hz
a strong signal, representing the described horizontal-plane scan for the horizontal component of the earth's magnetic field, i.e., North.

At 99 Hz
At 100 Hz
At 101 Hz
strong sideband signals (99 Hz and 101 Hz) about a weak 100 Hz center frequency, representing the described horizontal-plane scan for the horizontal component of instantaneous probe-axis inclination, i.e., tilt azimuth.

At 5 and at 10 k Hz
a low-level ripple, most of which has already been removed by the filter 80.

Signal $V_A$:

At 1 Hz
a strong signal, representing the horizontal-plane scan for tilt azimuth.

At 99 Hz
At 100 Hz
At 101 Hz
strong sideband signals (e.g., 99 Hz and 101 Hz) characterized by sharp edges, due to the square-wave mixing at 100 Hz and representing the scan of the earth's field; the center frequency (100 Hz) is de minimis.

The probe-output signals $V_A$ and $V_B$ are telemetered to the surface as electrical currents, where they are received by buffers 89–90 and converted back to voltages. The signals then go through filters 91–92 to remove some of the noise picked up in transmission over the cable, as well as such ripple as may remain from the modulation-demodulation processes already described. Typically, these are notch filters tuned to reject the modulation frequency (100 Hz); thus, output of filter 91 is essentially the A signal (1 Hz scan for tilt azimuth) and output of filter 92 is essentially the B signal (1 Hz scan for the horizontal component of the North-referenced earth's field). The North direction, available from the B-signal output of filter 92 provides a convenient zero-azimuth reference against which to develop phase-displacement data pertaining to the instantaneous tilt azimuth present in the A-signal output of filter 91. And in the preferred form to be described, I choose to develop such phase-displacement data in the form of two quadrature components of the tilt-azimuth vector; these tilt-azimuth components are developed as "North" and "East" components, being d-c signals in output line 93 to the "East"—recording stylus of recorder 19 and in output line 94 to the "North"—recording stylus of recorder 19; a negative polarity for either of these signals will be indicative of "South" and "West" components, as the case may be. A phase-locked loop which defines the quadrature component of the $V_B$ signal is used to generate the basic square waves by which synchronous detection accurately segregates the indicated "North" and "East" signals supplied to the chart recorder 19, all as will be more fully explained.

First, in discussing the phase-locked loop for basic synchronizing purposes, additional reference will be made to the series of curves depicted to the same time scale in FIG. 7, wherein curves a and b respectively depict the characteristic 1 Hz signals B and A already described, and shown for an illustrative tilt-azimuth offset $\psi$ with respect to North. The phase-locked loop components are those which utilize the branch 95 from filter 92 to a multiplier (synchronous detector) 96. The phase-locked loop relies upon a voltage-controlled oscillator (VCO) 97 operating at four times the rotational-scan rate of sensor 22, so that its output to a ring divider 98 is at 4 Hz, with square-wave outputs 99–100 which are displaced 90° from one another and at the scan frequency 1 Hz; these square-wave outputs are depicted at curves c and d of FIG. 7.

The B-signal and A-signal curves of FIGS. 7*a* and *b* may each be characterized by a constant voltage offset, labeled $\eta_B$ and $\eta_A$, respectively, but the preferred technique of synchronous detection effectively ignores such offsets. For example, in the case of the square wave in line 99 to detector 96, the square-wave operation upon signal B involves just as much time at +1 amplitude as at the −1 amplitude with which it alternates; the result of multiplying such a square wave by the constant $\eta_B$ and then integrating at 101 for one period (T) is zero. The same may be said for multiplication of the other square wave (line 100) at 102 with another branched output of filter 92 (signal B), so that upon integration of the constant $\eta_B$ at 103 for one period (T), the result is again zero. The undesired constant terms $\eta_A$ and $\eta$ are thus inherently rejected by the described circuitry.

Having thus rejected $\eta_B$, the product of signal B with the square wave of line 99, i.e., at the output of detector 96 is as displayed at curve e of FIG. 7. As drawn, for the perfect case of square wave (line 99) phase-displaced 90° from signal B, the integral over one period (T) of signal B will be zero. But if, on the other hand, the phase of the square wave in line 99 were to shift in either direction with respect to signal B, the symmetry of the detected output of multiplier 96 will be destroyed, thus producing a non-zero or error result at 104 for a period (T) of integration at 101, and the polarity of this error will be indicative of the direction of the phase shift. A sample-and-hold circuit (S/H) 105 is provided to retain this error signal, with a feedback connection 101' at the input to integrator 101, sampling being shown under synchronizing control of a one-shot multivibrator 106 operating from the square-wave output line 100; and the voltage-controlled oscillator 97 will be caused to speed up or slow down, depending upon the magnitude and polarity of error available from the sample-and-hold circuit 105. It will be understood that the parameters and polarities in the loop involving oscillator 97, divider 98, detector 96, integrator 101, sample-and-hold 105 and a loop filter 107 are such that equilibrium is automatically restored, i.e., if the square wave in line 99 should lag (or lead) for any reason (with respect to its desired 90° relation to the 1 Hz sine wave of signal B, the detected error signal available at 105 will speed up (or retard) oscillator 97 to remove the error. The net result is that the square wave in line 99 is locked in quadrature with signal B in the phase relation drawn at curve e of FIG. 7.

By the same token, the other square-wave output of divider 98 in line 100 is also phase-locked to the sine wave of signal B, but in view of the 90° relation between square waves in lines 99 and 100, the phase lock in line 100 is in-phase with the sine wave of signal B. Thus, upon multiplying at 102, signal B becomes synchronously rectified, as depicted at curve f of FIG. 7. Integration at 103, sample-and-hold at 108, and feedback 103' are analogous to functions already described, under the same synchronizing control from multivibrator 106, to produce a d-c output $B_H$ which is a direct measure of the magnitude of the horizontal component of the earth's field; this direct measure is indicated by legend at curve f of FIG. 7, namely, the average of the full-wave rectified signal B, or $(2/\pi)\cdot B_H$, it being understood that the loop formed by integrator 103, sample-and-hold 108, and summing junction 103' is such that the output of sampe-and-hold 108 will be adjusted until it balances the input, namely, until the sample-and-hold output stabilizes at $2/\pi B_H$. Since all scanning is in a horizontal plane, the quantity $B_H$ should remain constant, in the absence of a malfunction, and I indicate monitoring means 109 responsive to the d-c $B_H$ voltage to provide appropriate alarm or other warning in the event of a predetermined departure from constancy of $B_H$. In similar fashion, a second monitor 110 at the readout installation 18 may respond to loop-error signals retained at the sample-and-hold circuit 105 (hopefully zero), to assure correct phase-locked conditions at all times.

The remaining read-out circuitry of FIG. 6 utilizes the two 90°-spaced square waves of lines 99–100 to operate upon separately branched outputs of the filter 91, the local source of signal A. A first or North component of signal A is obtained by synchronous detection at 111, using the in-phase square wave available in line 100. Integration at 112 for the period T, sample-and-hold at 113 using the synchronizing pulse from multivibrator 106, and feedback to 112' of the retained d-c level at 113, represent functions and circuitry as described for development of the magnitude of a d-c signal proportional to $B_H$, the magnitude of the horizontal component of magnetic North; however, in the case of circuit elements 111–112–113, the legend at output 94 indicates the d-c output to be the "North" component of the probe-tilt vector, i.e., probe azimuth in the horizontal plane, namely proportional to the locally generated field vector amplitude $A_H$, times $\sin\alpha\cdot\cos\psi$, where $\alpha$ is the angle of tilt from the vertical, and where $\psi$ is the horizontal plane azimuth angle with respect to the horizontal component of the earth's magnetic North. In similar fashion, the quadrature or "East" component is produced at 93 by synchronous detection of the signal A at 115, using the 90°-shifted square wave in the line 99, integration at 116, and sample-and-hold at 117; and the legend at 93 describes this "East"-component d-c output as proportional to $A_H\sin\alpha\cdot\sin\psi$. In the cases of both the "North" and "East" d-c outputs, the proportionality factor is the same $(2/\pi)$ representing an averaging of synchronously detected sinusoidal voltages. Thus, amplitudes of both the "North" and "East" (in-phase and quadrature) components of tilt may be plotted at 19 to the same scale, or otherwise processed as truly comparable quantities. For example, display circuitry suggested at 118 will be understood to present at the panel of readout 18 a suitable rendition of the vendor sum (i.e., the resultant) of the "North" and "East" tilt components, shown as digital expressions of resultant Azimuth and resultant Amplitude.

Aside from the preferred form (FIG. 3) to which attention has thus far been devoted, there may be occasions in which the invention may take other forms. Examples of such other forms are provided in the simplified and schematic illustrations of FIGS. 8 to 11.

The arrangement of FIG. 8 differs from FIG. 3 in the manner in which gravitational force is employed to establish the vertical orientation of the spindle 23 which carries the flux sensor 22. In FIg. 8, this is accomplished by a bottom-heavy float 120, neutrally buoyant in a liquid medium, in place of the pendulous bob 28 of FIG. 3 (or 48, in FIG. 4). Float 120 will be understood to be equipped with two vertically spaced jewel bearings for rotational and vertical accommodation of spindle 23, and a liquid-immersed retaining cage 121 fixed centrally of the probe case has free-running clearance with float 120 and assures free assumption and retention of vertical-axis orientation of spindle 23, within specified limits of probe-tilt capability. The cage is shown with a circular upper opening through which spindle 23 is free to project within the range of tilt capability of the device. Float 120 and its cage 121 are positioned near the lower end of a liquid-filled chamber 122 between upper and lower closure plates 123–124, and scanning drive to the spindle is imparted via a torsion wire (piano wire) as described at 24 in FIG. 3. The motor 25 and slip-ring assembly 27 are shown installed above the upper plate 123, it being understood that the torsion wire 24 and the fine lead wires to and from the flux sensor 22 are accommodated as previously described, being passed through suitable stuffing gland means at plate 123; local excitation coils as at 53–54 in FIG. 4 are not shown in FIG. 8, but their use will be understood, with sensor 22 at all times centrally suspended between such coils. Electrically, and magnetically, the operation of FIG. 8 is precisely as described for FIGS. 3 to 7, in that the directional magnetic response of the sensor 22 is caused to scan at a slow rate (e.g., 1 Hz) in the horizontal plane, for concurrent response to the horizontal component of the earth's field and to the locally generated probe-axis field within and between coils, as at 53—54. Although spindle 23 (with sensor 22) has been described as being rotatable in spaced bearings in float 120, it will be understood that in a suitably balanced situation, these parts may be fixed to each other (i.e., to the float 120) and rotatable in unison; again, however, my preference is to have the spindle and its sensor rotated in vertical-axis orienting bearings in the float 120.

In the arrangement of FIG. 9, there is no pendulum, float or any other means relied upon for vertical-axis orientation of the rotating flux sensor 22, suspended and driven by a torsion wire 24 of sufficient length and flexibility to pendulously assume, on its own, a vertical axis of rotation, at the location of sensor 22. Motor 25 and slip-ring assembly 27 (for the thin lead wires serving sensor 22) are case-mounted as in the FIG. 3 arrangement. The limitation of FIG. 9 is of course the size of the open volume within the probe case, within which to allow a sufficiently along torsion wire 24 to assume the indicated vertical axis of orientation. Also, for constant immersion of sensor 22 in a local straight-line field in which to scan horizontally for signal-A data (the requisite coils corresponding to coils 53–54 being omitted again in FIG. 9, for clarity of presentation), there is another important limitation on inside diameter of the probe. Thus, the technique of FIG. 9 is applicable only in probes of sufficiently large internal girth.

In the form of FIG. 10, the elongate frame 126 is a rigid body having central end-shaft formations to enable rotation with the probe and on the central axis of the probe, suspension being via longitudinally spaced bearings 127–128 in the frame structure of the probe case. A two-axis gimbal system suspends a pendulum bob 48 at a location midway along frame 126, the respective gimbal axes being designated 129–130 in FIG. 10. As with FIGS. 3 and 4, the pendulous mass 48 (28) establishes constant vertical orientation for bearings (not shown) in which spindle 23 may rotate. Lead-wire accommodation of the probe 22 is shown as loose coils at 131 to allow frictionless adaptation to tilt, the lead wires being otherwise wrapped or tied to nearby rotating-frame structure, for guidance to the slip-ring means 27. The local Helmholtz coils, analogous to coils 53–54 in FIG. 4, are again not shown in FIG. 10 but will be understood to either be carried by the rotating frame 126 at locations closely above and below the gimbal system 129–130 or, alternatively, to be case-mounted at equivalent longitudinal locations immediately outside the geometrical cylinder generated by rotation of frame 126.

The still further alternative of FIG. 11 is applicable only to a situation in which the probe case itself rotates about its own axis, as when the probe is carried with a rotationally driven drill assembly, so that the drill-bit rotation can be relied upon to generate the rotation needed for horizontal-plane scanning of the invention. The component parts of FIG. 11 will be recognized from FIG. 10, with the sole difference that frame 126 is effectively part of the probe case, being rotated therewith, rather than with respect thereto as in FIG. 11. Corresponding parts are therefore given the same reference numerals, and it is noted that the need for motor 25, slip rings 27 and bearings 127–128 is avoided in FIG. 10, case rotation with the drill (not shown) being suggested by arrows 132.

In the logging or mapping of a drill hole, as in the described case of drilling for mineral-ore mapping at depth, readout purposes at the logging van 16 are well and adequately served by the following outputs, all of which have been accounted for in the foregoing description:

1. "North" ("South") horizontal component of probe-axis tilt, as a function of borehole depth, the same being chart-recorded at 19.

2. "East" ("West") horizontal component of probe-axis tilt, as a function of borehole depth, the same being chart-recorded at 19.

3. Absolute magnitude of the horizontal component $B_H$ of earth's magnetic North, with means for monitoring the same (at 109) for constant magnitude, as a verification that important components of the system are properly functioning; I indicate my preference that design values be selected such that the resultant horizontal component of the probe-tilt vector at maximum tilt (here assumed to be 20° from the vertical) shall be equal or substantially equal to the magnitude of the horizontal component $B_H$ of magnetic North.

4. Monitoring at 110 for presence of loop error, as a verification that phase-locked operation is a continuing and accomplished fact, upon which described synchronous detection and rectification functions can be known to be properly relying.

In other applications of the invention, as when the probe of the invention is but a sensing tool carrier with a drill bit in order to enable drill-direction instructions to be issued to the drill mechanism, it is of course important that probe-derived data shall be accurately referenced to the probe itself. For a rotating probe-and-drill combination, as noted in connection with FIG. 11, this requirement presents no particular problem because the probe case and the drill bit will always be mechanically anchored against their relative rotation, thus making probe-derived tilt-change or tilt-correction signals (Δ signal A, via corresponding increments of its described orthogonal "North" and "East⇄ components) directly applicable to the steering or tilt correction of the drill. In other embodiments, in which the sensor 22 is rotated with respect to the probe case, for horizontal-plane scanning purposes, the necessary probe-case reference for such scanning can be readily derived by a variety of known case-angle marking techniques. One such technique employs a local case-mounted light source and photocell, directionally responsive to the instant (once per scan revolution) when a small mirror surface carried by sensor 22 casts its reflection upon the photocell. The components of such a case-angle marking system are schematically suggested in FIG. 10 to comprise a light source 133, a photocell 134, and a marker-pulse generator 135 responding to the photocell output for each reflection from sensor 22. Armed with such case-angle reference, even for a scanner 22 driven in rotation with respect to the case, those skilled in the art will understand that drill-steering signals are directly derivable at the probe which accompanies the drill bit.

It will be seen that the described invention provides a marked advance over existing techniques of bore-hole mapping and drilling. Data derived from a single scanner provides instant and current readout of vital orientation and position facts pertaining to a probe which may be very remote from the logging van at the surface. Moreover, the data (being in analog form) are directly utilizable for use and display with uncompromised accuracy and lend themselves to immediate remote transmission, quantizing for digital expression, computer use, and the like as may be desired. Delays and other significant technical compromises and limitations of the prior art are avoided.

While the invention has been described in detail for preferred forms, it will be understood that modifications may be made without departure from the scope of the invention. For example, synchronous detection and synchronous rectification will be understood to represent my current preference for what may otherwise be viewed as sharp or tuned filtering, as to which other techniques are known and well understood and may be preferred by others.

Also by way of example, while it is convenient to rely upon continuous, unidirectional rotation of the flux sensor 22 for horizontal-plane scanning, such rotation is not necessarily a prerequisite for operability of the invention. Thus, for example, to avoid use of slip rings between rotatable and non-rotatable parts, the rotatable structure which importantly includes sensor 22 need only perform at most a single rotation (in a horizontal plane) to have obtained its necessary scan data, and therefore a 360° oscillation (as via a torsional elastic oscillation via wire 24) could also provide such data, all without hysteresis-lag effects because the single sensor 22 directly generates all the data needed, regardless of the direction of passage of its response axis n through the North and azimuth bearings of interest.

What is claimed is:

1. A borehole drift-direction probe, comprising an elongate housing of length and diameter selected for reliable assumption of housing-axis orientation parallel to the locally applicable borehole-axis orientation, a rotary spindle with magnetic flux-sensor means mounted theretofor directional response normal to the spindle axis, means suspending said spindle with universal action with respect to said housing, said suspension means including gravitationally sensitive means for maintaining a constant vertical orientation of the spindle axis, motor means connected to said spindle for imparting continuous rotation thereto, whereby said flux-sensor means will develop an electrical output signal which is cyclically responsive to the horizontal component of the local direction of the earth's magnetic-field lines, electric-coil means fixedly mounted within said housing and positioned when excited to establish at said flux-sensor means a magnetic field of substantially uniformly distributed straight lines and parallel to the housing axis, means for exciting said electric-coil means, whereby the electrical output of said magnetic-sensor means is additionally characterized by an output signal which is cyclically responsive to instantaneous housing-axis inclination with respect to the vertical, and means for remotely transmitting said output signals.

2. The borehole drift-direction probe of claim 1, in which said excitation means comprises an a-c source of frequency greater than the rotational frequency of said spindle.

3. The borehole drift-direction probe of claim 2, in which synchronous-detector means is coupled to the output of said flux-sensor means, whereby the output signal which is responsive to instantaneous housing-axis inclination is segregated from the output signal which is responsive to the horizontal component of the local direction of the earth's magnetic field.

4. The borehole drift-direction probe of claim 2, in which the a-c source frequency is in the order of 100 Hz and the spindle-rotation frequency is very much less than 100 Hz.

5. The borehole drift-direction probe of claim 4, in which the spindle-rotation frequency is in the order of 1 Hz.

6. The borehole drift-direction probe of claim 1, in which said motor means is fixedly mounted in said housing with its output shaft facing downwardly on the housing axis, and universal-coupling means connecting said spindle to the output shaft of said motor means.

7. The borehold drift-direction probe of claim 6, in which said spindle-suspension means includes vertically spaced spindle-engaging bearings in which said spindle has a degree of axial-positioning motional freedom, whereby said spindle may be vertically erect in its continuous rotation regardless of any slight changes in the distance between said spindle and said motor means as a function of inclination of said housing axis.

8. The borehole drift-direction probe of claim 7, in which said coupling means is a length of piano wire of such length and flexibility as to present negligible resistance to the ability of said gravitationally sensitive means to maintain the vertical orientation of the spindle axis.

9. The borehole drift-direction probe of claim 1, in which said suspension means includes a pendulum mounted in said housing on a two-axis signal system, and spindle-erecting bearing means carried by said pendulum.

10. The borehole drift-direction probe of claim 1, in which said coil means comprises axially spaced turns on opposite axial sides of the axial location of said flux-sensor means and of diameter at least as great as the axial spacing of said turns.

11. The borehole drift-direction probe of claim 10, in which said turns diameter substantially exceeds said axial spacing.

12. The borehole drift-direction probe of claim 1, in which said flux-sensor means is a Hall-effect transducer.

13. The borehole drift-direction probe of claim 1, in which said flux-sensor means includes a local carrier-frequency excitation source therefor, the carrier frequency being substantially greater than the scan rate imparted by said motor means.

14. The borehole drift-direction probe of claim 13, in which said coil-excitation means is a source of alternating current at a frequency intermediate said scan rate and said carrier frequency.

15. The borehole drift-direction probe of claim 14, in which said carrier frequency is also substantially greater than that of said coil-excitation means.

16. The borehole drift-direction probe of claim 1, in which said signal-generator means includes coacting housing-mounted non-rotatable component means and spindle-mounted rotatable component means for identifying the instant at which a selected part of the flux-sensor scan traverses the effective angular location of said non-rotatable component means.

17. A borehole drift-direction probe, comprising an elongate housing of length and diameter selected for reliable assumption of housing-axis orientation parallel to the locally applicable borehole-axis orientation, a rotary spindle with magnetic flux-sensor means mounted thereto for directional response normal to the spindle axis, means suspending said spindle with universal action with respect to said housing, said suspension means including gravitationally sensitive means for maintaining a constant vertical orientation of the spindle axis, motor means fixedly mounted in said housing with its output shaft facing downwardly on the housing axis, universal coupling means connecting said spindle to said output shaft for imparting continuous rotation thereto, whereby said flux-sensor means will develop an electrical output signal which is cyclically responsive to the horizontal component of the local direction of the earth's magnetic-field lines, electric-coil means fixedly mounted within said housing and positioned when excited to establish at said flux-sensor means a magnetic field of substantially uniformly distributed straight lines and parallel to the housing axis, means for exciting said electric-coil means, whereby the electrical output of said magnetic flux-sensor means is additionally characterized by an output signal which is cyclically responsive to instantaneous housing-axis inclination with respect to the vertical, and means for remotely transmitting said output signals.

18. The borehole drift-direction probe of claim 17, in which said gravitationally sensitive means is a bottom-heavy float, and in which said housing includes a liquid-filled chamber in which said float is neutrally buoyant.

19. The borehole drift-direction probe of claim 18, in which said chamber includes a central retaining cage in clearance relation with said float for containing float location, generally to the axially central region of said probe.

20. The borehole drift-direction probe of claim 18, in which said spindle is fixed to said float whereby said float and sensor rotate in unison, said sensor being contained within said float.

21. The borehole drift-direction probe of claim 18, in which said spindle is rotatable in spaced vertically-orienting spindle bearings in said float.

22. The borehole drift-direction probe of claim 1, and including synchronous commutating means comprising commutating square-wave generator means responsive to the output signal responsive to the horizontal component of the earth's field to develop a first square wave in phase with said earth's field signal and a second square wave in 90° phase-offset from said in-phase signal, first means synchronously detecting with said in-phase square wave the output signal responsive to housing tilt to derive the "North" component of the horizontal-plane component of housing tilt, and second means synchronously detecting with said 90° phase-offset square wave the output signal responsive to housing tilt to derive the "East" component of the horizontal component of housing tilt.

23. The borehole drift-direction probe of claim 1, and including cable-displacement responsive means responsive to cable pay-out to said probe at depth in a borehole to be mapped, and display means connected to said displacement-responsive means and to said "North" and "East" component signals for correlating such component signals as a function of pay-out depth.

24. The borehole drift-direction probe of claim 23, in which said display means includes a chart recorder, with chart drive synchronized by said cable-displacement-responsive means.

25. The borehole drift-direction probe of claim 22, and including display means responsive to said "North" and "East" component signals for vectorially summing the same to determine the resultant horizontal-plane tilt-vector component and for displaying the same both as to magnitude and azimuth.

26. The borehole drift-direction probe of claim 17, in which said gravitationally sensitive means comprises and elongate flexible torsion wire which additionally comprises said universal coupling means, said wire being of such length and flexibility as to pendulously assume vertical orientation of said spindle at its lower end, whereby sensor scan in a horizintal plane is achieved without constraint imposed upon said spindle or said wire.

27. The borehole drift-direction probe of claim 17, in which said means suspending said spindle with universal action comprises a rigid frame mounted for motor-driven rotation on the probe axis, a two-axis gimbal system carried by and within said frame, said gravitationally-sensitive means being suspended by said gimbal system, said spindle being vertically oriented by said grativationaly sensitive means, whereby said frame and gimbal system and sensor all rotate in unison in the course of horizontal-plane scanning by said sensor.

28. The method of continuously tracking local axis inclination in a borehole using a single magnetic flux sensor within an elongate probe housing, wherein the housing length and diameter proportions have been selected for reliable ssumption of housing-axis orientation parallel to the locally applicable borehole axis orientation, which method comprises orienting said flux sensor for directional response normal to an axis of rotation, continuously rotating said flux sensor about said axis of rotation, gravitationally maintaining a constant vertical orientation of said axis of rotation, whereby the flux sensor will develop a first electrical output-signal component which is cyclically responsive to the horizontal component of the local direction of the earth's magnetic-field lines, establishing within said housing and in the region of flux-sensor rotation a magnetic field of substantially uniformly distributed straight lines parallel to the axis of the probe housing, whereby the electrical output of the flux sensor will be additionally characterized by a second component signal which is cyclically responsive to instantaneous housing-axis inclination with respect to the vertical, segregating said components, monitoring the amplitude of the second component signal, and monitoring the phase relationbetween said first and second component signals.

29. A borehole drift-direction probe for use in a rotated-probe context, as in conjunction with a rotated boring tool, comprising an elongate housing of length and diameter selected for reliable assumption of housing-axis orientation parallel to the locally applicable borehole-axis orientation, a spindle with magnetic flux-sensor means mounted thereto for directional response normal to the spindle axis, means non-rotationally suspending said spindle with universal action with respect to said housing, said suspension means including gravitationally sensitive means for maintaining a constant vertical orientation of the spindle axis, whereby in the course of probe rotation said flux-sensor means will develop an electrical output signal which is cyclically responsive to the horizontal component of the local direction of the earth's magnetic-field lines, electric-coil means fixedly mounted within said housing and positioned when excited to establish at said flux-sensor means a magnetic field of substatially uniformly distributed straight lines and parallel to the housing axis, means for exciting said electric-coil means, whereby the electrical output of said magnetic flux-sensor means is additionally characterized by an output signal which is cyclically responsive to instantaneous housing-axis inclination with respect to the vertical, and means for remotely transmitting said output signals.

30. A borehole drift-direction probe, comprising an elongate housing of length and diameter selected for reliable assumption of housing-axis orientation parallel to the locally applicable borehole-axis orientation, a rotary element including magnetic flux-sensitive means having directional response normal to the axis of rotation of said element, means suspending said element with universal action with respect to said housing, said suspension means including gravitationally sensitive means for maintaining a constant vertical orientation of said axis of rotation, motor means associated with said element for importing continuous rotation thereto, whereby said flux-sensitive means will develop an electrical output signal which is cyclically responsive to the horizontal component of the local direction of the earth≦s magnetic-field lines, electric-coil means fixedly mounted within said housing and positioned when excited to establish at said flux-sensitive means a magnetic field of substantially uniformly distributed straight lines and parallel to the housing axis, means for exciting said electric-coil means, whereby the electrical output of said magnetic-sensitive means is additionally characterized by an output signal which is cyclically responsive to instantaneous housing-axis inclination with respect to the vertical, and means for remotely transmitting said output signals.

31. A borehole drift-direction probe, comprising an elongate housing of length and diameter selected for reliable assumption of housing-axis orentation parallel to the locally applicable borehole-axis orientation, a rotatable element including magnetic flux-sensitive means having directional response normal to the axis of rotation of said element, means suspending said element with universal action with respect to said housing, said suspension means including gravitationally sensitive means for maintaining a constant vertical orientation of said axis of rotation, means associated with said element for imparting rotation thereto, whereby said flux-sensitive means will develop an electrical output signal which is responsive to the horizontal component of the local direction of the earth's magnetic-field lines, electric-coil means fixedly mounted within said housing and positioned when excited to establish at said flux-sensitive means a magnetic field of substantially uniformly distributed straight lines and parallel to the housing axis, means for exciting said electric-coil means, whereby the electrical output of said magnetic-sensitive means is additionally characterized by an output signal which is responsive to instantaneous housing-axis inclination with respect to the vertical, and means for remotely transmitting said output signals.

32. The borehole drift-direction probe of claim 31, in which the imparted rotation is oscillatory.

33. The method of determining local axis inclination in a borehole using a single magnetic flux-sensitive device within an elongate probe housing, wherein the housing length and diameter proportions have been selected for reliable assumption of housing-axis orientation parallel to the locally applicable borehole axis orientation, which method comprises orienting said flux-sensitive device for directional response normal to an axis of rotation, rotating said flux sensor about said axis of rotation, gravitationally maintaining a constant vertical orientation of said axis of rotation, whereby the flux sensor will develop a first electrical output-signal component which is responsive to the horizontal component of the local direction of the earth's magnetic-field lines, establishing within said housing and in the region of flux-sensor rotation a magnetic field of substantially uniformly distributed straight lines parallel to the axis of the probe housing, whereby the electrical output of the flux sensor will be additionally characterized by a second component signal which is responsive to instantaneous housing-axis inclination with respect to the vertical, segregating said components, monitoring the amplitude of the second component signal, and monitoring the phase relation between said first and second component signals.

34. The method of claim 33, in which said rotation oscillates as to the direction of rotation.

35. The method of continuously tracking local axis inclination in a borehole using a single magnetic flux sensor within an elongate probe housing, wherein the housing length and diameter proportions have been selected for reliable assumption of housing-axis orientation parallel to the locally applicable borehole axis orientation, which method comprises orienting said flux sensor for directional response normal to an axis of rotation, continuously rotating said flux sensor about said axis or rotation, gravitationally maintaining a constat vertical orientation of said axis of rotation, whereby the flux sensor will develop a first electrical output-signal component which is cyclically responsive to the horizontal component of the local direction of the earth's magnetic-field lines, establishing within said housing and in the region of flux-sensor rotation a magnetic field of substantially umiformly distributed straight lines parallel to the axis of the probe housing, whereby the electrical output of the flux sensor will be additionally characterized by a second output-signal component which is cyclically responsive to instantaneous housing-axis inclination with respect to the vertical, segregating said components, generating from said first output-signal component a first or in-phase switching signal having in-phase relation to said first output-signal component and a second or quadrature-phase switching signal having quadrature-phase relation to said first output-signal component, using said in-phase switching signal for synchronously detecting said second output-signal component to derive the "North" component of instantaneous probe-axis tilt, and using said quadrature-phase switching signal for synchronously detecting the "East" component of instantaneous probe-axis tilt.

36. The method of claim 35, in which said probe-housing is paid out via cable from a monitoring station, and separately recording via said monitoring station the respective magnitudes of said detected "North" and "East" components, said magnitudes being concurrently recorded as a function of the instantaneous length of paid-out cable.

* * * * *